United States Patent [19]

Nichols

[11] Patent Number: 4,646,763

[45] Date of Patent: Mar. 3, 1987

[54] ADJUSTABLE FILTER CIGARETTE

[75] Inventor: Walter A. Nichols, Richmond, Va.

[73] Assignee: Philip Morris Incorporated, New York, N.Y.

[21] Appl. No.: 799,747

[22] Filed: Nov. 19, 1985

[51] Int. Cl.[4] ..... A24D 3/04

[52] U.S. Cl. ..... 131/336; 131/338; 131/198.2

[58] Field of Search ..... 131/336, 338–341, 131/361, 198.1, 198.2

[56] References Cited

U.S. PATENT DOCUMENTS

| | | | |
|---|---|---|---|
| 3,327,718 | 6/1967 | Kilburn | 131/262 |
| 3,359,988 | 12/1967 | Thomson | 131/10.3 |
| 3,376,874 | 4/1968 | Kim et al. | 131/207 |
| 3,428,050 | 2/1969 | Kandel | 131/10.3 |
| 3,490,461 | 1/1970 | Osmalov et al. | 131/10.5 |
| 3,503,406 | 3/1970 | Riegel et al. | 131/10 |
| 3,504,678 | 4/1970 | Pitt | 131/10.5 |
| 3,512,537 | 5/1970 | Pelletier | 131/9 |
| 3,608,561 | 9/1971 | Dock | 131/10 A |
| 3,738,375 | 6/1973 | Doumas | 131/10.3 |
| 3,789,855 | 2/1974 | Norman | 131/9 |
| 4,340,074 | 7/1982 | Tudor | 131/362 |
| 4,526,183 | 7/1985 | Nichols et al. | 131/338 |
| 4,527,573 | 7/1985 | Hausermann | 131/336 |
| 4,532,943 | 8/1985 | Nichols et al. | 131/336 |
| 4,570,649 | 2/1986 | Nichols et al. | 131/338 |
| 4,600,027 | 7/1986 | Houk et al. | 131/338 |

FOREIGN PATENT DOCUMENTS

| | | |
|---|---|---|
| 0105683 | 4/1984 | European Pat. Off. . |
| WO84/01273 | 4/1984 | PCT Int'l Appl. . |
| 1058343 | 2/1967 | United Kingdom . |
| 2099678 | 12/1982 | United Kingdom . |

*Primary Examiner*—V. Millin
*Assistant Examiner*—H. Macey
*Attorney, Agent, or Firm*—Jeffrey H. Ingerman

[57] ABSTRACT

A variable dilution cigarette, of the type having a filter with two relatively rotatable segments having slits in the plug wrapping and the tipping paper which rotate in and out of rotational registry to vary the dilution level, is provided which is insensitive to slight longitudinal misalignment of the slits. An array of longitudinal depressions is formed in one segment of the filter plug centered on the slit in the plug wrapping and ending short of both ends of the filter segment containing the slit. The depressions act as a plenum allowing the longitudinal flow of air between the slit in the tipping paper and the slit in the plug wrapping in case of longitudinal misalignment arising during use, but do not allow circumferential air flow when the slits are intentionally deregistered by relative rotation of the filter segments. Because the depressions do not reach the ends of the filter segment containing the slit, they do not allow any unwanted air into the filter.

14 Claims, 9 Drawing Figures

ADJUSTABLE FILTER CIGARETTE

BACKGROUND OF THE INVENTION

This invention relates to filter cigarettes. More particularly, the present invention relates to filter cigarettes which are adjustable by the smoker to vary the air dilution value.

It is known to produce variable dilution cigarettes having integral rotatable elements for controlling dilution. The rotatable element can be a rotatable band of tipping paper retained by stationary bands against axial displacement and having a slit overlying a slit in the filter plug wrap with which it can be rotated into and out of registry. Alternatively, it can be a rotatable section of the filter plug, carrying with it a section of tipping paper extending over a stationary section of the filter plug. The extending section of the tipping paper has a slit which overlies a slit in the plug wrap on the stationary filter plug segment. The slits can be moved in and out of registry by rotating the rotatable filter segment. Such a cigarette is described in commonly-assigned U.S. Pat. No. 4,532,943, which is hereby incorporated by reference in its entirety.

In the manufacture of these types of cigarettes, the slits in the tipping paper and plug wrap are most easily formed by simultaneously slitting both layers with a knife or laser beam. The cigarettes are therefore assembled initially with the slits fully in registry both longitudinally and rotationally. The dilution level can then be adjusted by rotating the rotatable segment varying the rotational registry of the slits.

In such a cigarette, it is intended that the longitudinal registry of the slits not change as the filter segments are rotated. However, with certain constructions, rotation of the rotatable segment may cause longitudinal motion of the rotatable segment, affecting the longitudinal registry of the slits and impairing control of the dilution level.

It would be desirable to be able to provide a variable dilution cigarette of the type described above in which a change in the longitudinal registry of the slits does not affect control of the variable dilution feature.

SUMMARY OF THE INVENTION

It is an object of this invention to provide a variable dilution cigarette of the type described above in which a change in the longitudinal registry of the slits does not affect control of the variable dilution feature.

In accordance with the invention, a filter cigarette is provided which comprises a tobacco rod, a substantially cylindrical filter plug having a mouth end and a rod end both open to the passage of air and smoke, plug wrapping circumscribing the filter plug, and tipping paper circumscribing and joining the filter plug and a portion of the tobacco rod. At least one of the plug wrapping and tipping paper are substantially air-impermeable. The filter plug comprises a mouth-end segment axially connected to a rod-end segment for rotation about the axis of the cigarette, each segment having respective mouth and rod ends. The tipping paper has a first opening therein and the plug wrapping has a second opening therein underlying the first opening. The openings overlie one of the segments, such that rotation of the mouth-end segment relative to the rod-end segment varies the registry between the first and second openings for varying the air-dilution value of the cigarette. The segment that is overlain by the openings has an array of angularly closely-spaced longitudinal depressions extending from a first point remote from the mouth end of the segment to a second point remote from the rod-end of the segment. The openings are between the first and second points and within the array of depressions, such that the registry between the openings is insensitive to minor longitudinal misalignment arising during consumer use.

BRIEF DESCRIPTION OF THE DRAWINGS

The above and other objects and advantages of the invention will be apparent after consideration of the following detailed description, taken in conjunction with the accompanying drawings, in which like reference characters represent like parts throughout, and in which.

DETAILED DESCRIPTION OF THE INVENTION

Figure 1:
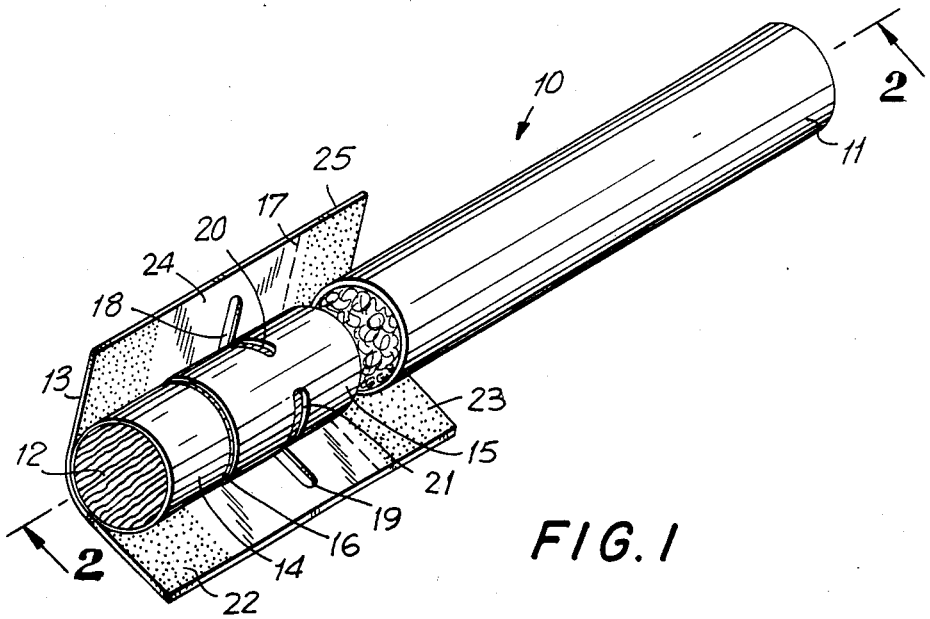
FIG. 1 is a fragmentary, partially exploded, perspective view taken from the mouth end of a variable dilution cigarette which may be subject to longitudinal misalignment.

A cigarette of the type described in said above-incorporated commonly-assigned U.S. Pat. No. 4,532,943, which is subject to longitudinal misalignment as discussed above, is illustrated in FIGS. 1-3. The cigarette 10 comprises a tobacco rod 11—that is, a charge of smoking material wrapped in cigarette paper—attached to an axially aligned, wrapped cylindrical filter plug 12, and tipping paper 13. The filter plug 12 has a mouth end and a rod end, both of which are open to permit passage of air and smoke, and is divided into first and second segments 14, 15 by a circumferentially extending cut 16 which defines a central, axial core 30 about which the first segment 14 can be rotated relative to the second segment 15. The tipping paper 13 circumscribes and joins the filter plug 12 to the tobacco rod 11 in abutting end-to-end relation. Tipping paper 13 extends from substantially the mouth end of the filter plug 12, where it is fastened to segment 14 by adhesive band 22, to a point on the tobacco rod 11 adjacent the rod end of the filter plug 12, where it is fastened to both segment 15 and tobacco rod 11 by adhesive band 23. Tipping paper 13 also has a perforated break line 17 at a point between the circumferential cut 16 and the tobacco rod 11, dividing it into two tipping paper sections 24, 25.

Two openings 18, 19 are made through the tipping paper 13 corresponding to two openings 20, 21 in the underlying portion of the filter plug wrap. When perforation line 17 is broken, tipping paper section 24 is free to rotate with first segment 14 of the filter plug 12 about the axis of central core 30, such that openings 18, 19 in the tipping paper 13 and openings 20, 21 in the underlying portion of the plug wrap are in varying degrees of registry. Adjustment of the degree of registry permits varying amounts of air to enter the filter and combine with the smoke, thereby varying the air dilution value of the cigarette.

Figure 3:
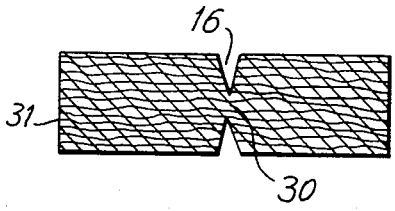
FIG. 3 is a cross-sectional view of the filter plug of the cigarette of FIGS. 1 and 2.
Figure 4:
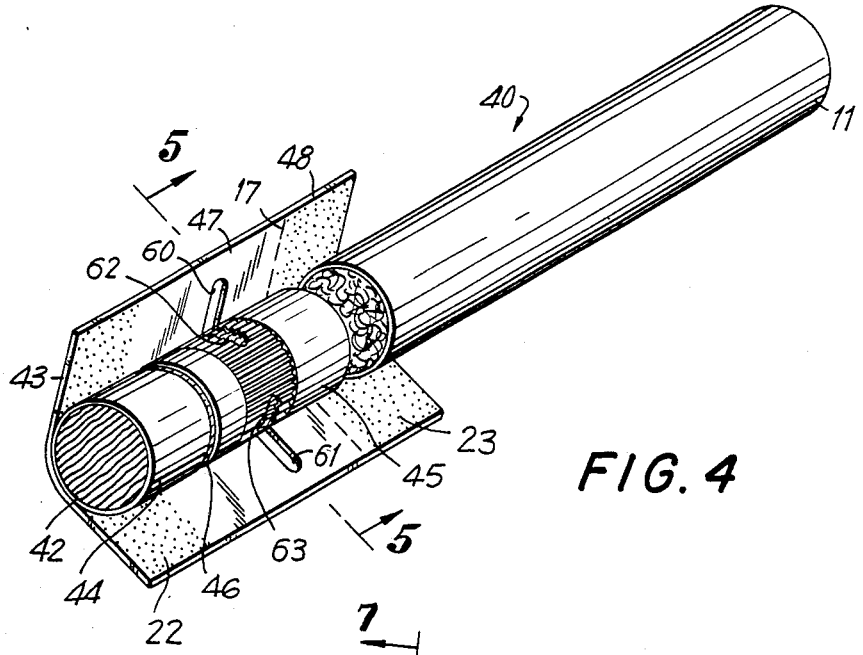
FIG. 4 is a fragmentary, partially exploded, perspective view taken from the mouth end of a cigarette according to the present invention.

As described above, such cigarettes are assembled by providing a filter plug such as untipped filter plug 31, shown in FIG. 3, and attaching it to a tobacco rod 11 by overwrapping both untipped plug 31 and rod 11 with a length of tipping paper 13 which has already been provided with perforated break line 17. The tipping paper 13 is bonded by adhesive band 22 to the mouth end of filter plug 31 and by adhesive band 23 to the rod end of filter plug 31 and to the adjacent end of tobacco rod 11. A pair of slits is made through both tipping paper 13 and the wrapping of untipped filter plug 31 by a knife or laser beam, or other suitable means, simultaneously forming openings 18 and 20 and openings 19 and 21, transforming untipped filter plug 31 into filter plug 12.

When segment 14 of filter plug 12 is rotated immediately after being assembled as described above, the twisting of central axial core 30 will cause core 30 to tend to shorten. However, because the portions of opposing filter segments 14, 15 radially outward of core 30 are in direct contact, core 30 cannot shorten. Instead, the fibers of core 30 stretch or lengthen to maintain the same overall core length while twisted. Because of the stresses and strains involved, they may never return to their original lengths. As a result, when segment 14 is rotated toward a more relaxed position of core 30, segment 14 may move slightly away from segment 15. Therefore, even when openings 18, 19 and 20, 21 are in rotational alignment, they may no longer be in longitudinal alignment, and the functioning of the variable dilution mechanism may be impaired.

The possibility of impairment of the functioning of the variable dilution mechanism can be minimized by reducing or eliminating the longitudinal motion of segments 14, 15. One way of reducing or eliminating the longitudinal motion is disclosed in copending, commonly-assigned U.S. Pat. application Ser. No. 761,631, filed Aug. 1, 1985.

The possibility of impairment of the functioning of the variable dilution mechanism can also be alleviated by constructing the cigarette in such a way that the variable dilution mechanism is insensitive to relative longitudinal motion of the filter segments. One such cigarette is shown in FIGS. 4–7. Cigarette 40 comprises tobacco rod 11 attached to axially aligned wrapped cylindrical filter plug 42, and tipping paper 43. Filter plug 42 is similar to filter plug 12, and is divided a first mouth-end segment 44 and a second rod-end segment 45 by circumferentially extending cut 46 which defines a central, axial core 64 similar to central axial core 30 of filter plug 12, about which segment 44 can be rotated relative to segment 45. Tipping paper 43 circumscribes and joins filter plug 42 to tobacco rod 11 as in cigarette 10. Tipping paper 43 extends from substantially the mouth end of filter plug 42, where it is fastened to segment 44 by adhesive band 22, to a point on tobacco rod 11 adjacent the rod end of filter plug 42, where it is fastened to both segment 45 and tobacco rod 11 by adhesive band 23. Perforated break line 17, located at a point between the circumferential cut 46 and the tobacco rod 11, divides tipping paper 43 into two tipping paper sections 47, 48.

Figure 5:
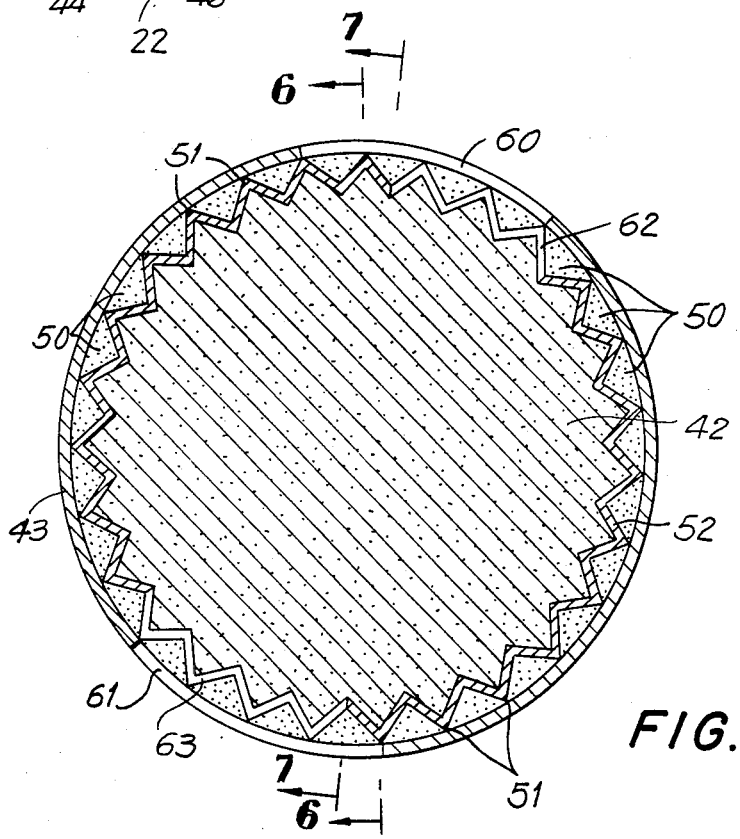
FIG. 5 is a radial cross-sectional view of the cigarette of FIG. 4, taken from line 5—5 of FIG. 4, but not exploded.
Figure 6:
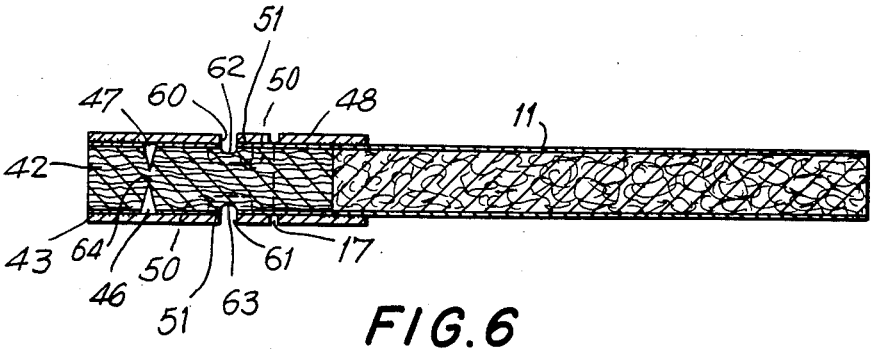
FIG. 6 is a longitudinal cross-sectional view of the cigarette of FIG. 4 taken from line 6—6 of FIG. 5.
Figure 7:
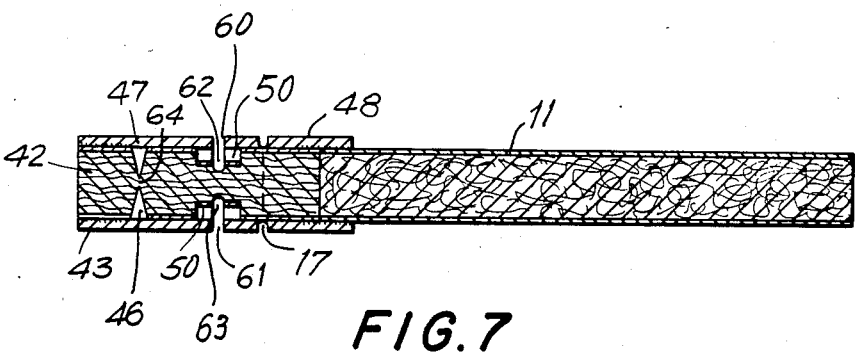
FIG. 7 is a longitudinal cross-sectional view of the cigarette of FIG. 4 taken from line 7—7 of FIG. 5.

Filter plug 42 differs from filter plug 12 in that an annular zone of longitudinal depressions 50 is formed in the surface of segment 45 remote from either end of the segment, so that each depression 50 runs from a first point remote from the mouth-end of segment 45 to a second point remote from the rod end of segment 45. Preferably, the depressions 50 are each about 2 mm to 4 mm long and less than about 1 mm deep, and peaks 51 between depressions 50 are flush with the surface of filter plug 42 outside the annular zone of depressions 50. Plug wrapping 52 conforms to depressions 50 and peaks 51 in the annular zone. Depressions 50 are preferably formed by embossing a filter plug such as filter plug 12. For ease of illustration, depressions 50 and peaks 51 are shown in FIG. 5 as being sharply angular. In practice, they may be more rounded.

At least one of tipping paper 43 and plug wrapping 52 is substantially air-impermeable. Preferably, both tipping paper 43 and plug wrapping 52 are substantially air-impermeable.

A pair of slits is formed by knife, laser beam, or other suitable means through both tipping paper 43 and plug wrapping 52 between the first and second points and overlying the zone containing depressions 50, simultaneously forming openings 60 and 61 in section 47 of tipping paper 43, and openings 62 and 63 in plug wrapping 52.

When openings 60 and 62, and 61 and 63, are in at least partial rotational registry, air can flow through openings 60, 61 into depressions 50 underlying those openings, and then into filter plug 42 through openings 62, 63 in plug wrapping 52. Longitudinal deregistration of openings 60, 62 and 61, 63 does not adversely affect operation of the variable dilution mechanism as long as it is not so great as to cause openings 60, 61 to be outside the zone of depressions 50. As long as openings 60, 61 remain in the zone of depressions 50, air can flow from openings 60, 61 longitudinally along depressions 50 until it reaches openings 62, 63. Depressions 50 thus function as a plenum for the variable dilution mechanism.

Use of depressions 50 as a plenum does not degrade the dilution control available in the cigarette of FIGS. 4–7. Because depressions 50 are outside the plug wrap 52 and do not reach the ends of rod-end segment 45, do they do not conduct any unwanted air into the interior of filter plug 42. Although they allow air to flow longitudinally, depressions 50 do not allow it to flow circumferentially, so that a particular degree of rotational registry in the cigarette of FIGS. 4–7 provides the same degree of dilution as in the cigarette of FIGS. 1–3. It is to prevent circumferential air flow that peaks 51 should be kept as flush as possible with the surface of filter plug segment 45 outside the zone of depressions 50, so that they are in contact with the inner surface of tipping paper 13.

Figure 2:
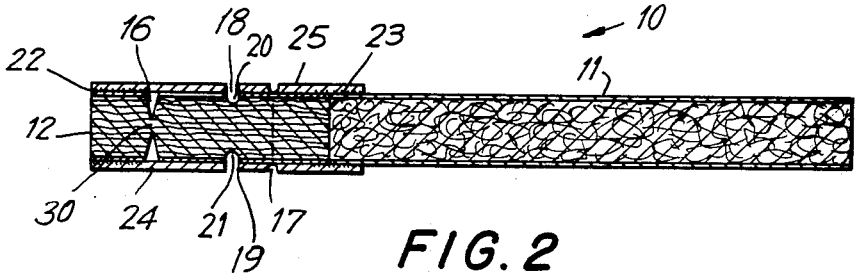
FIG. 2 is a cross-sectional view of the cigarette of FIG. 1, taken from line 2—2 of FIG. 1.
Figure 8:
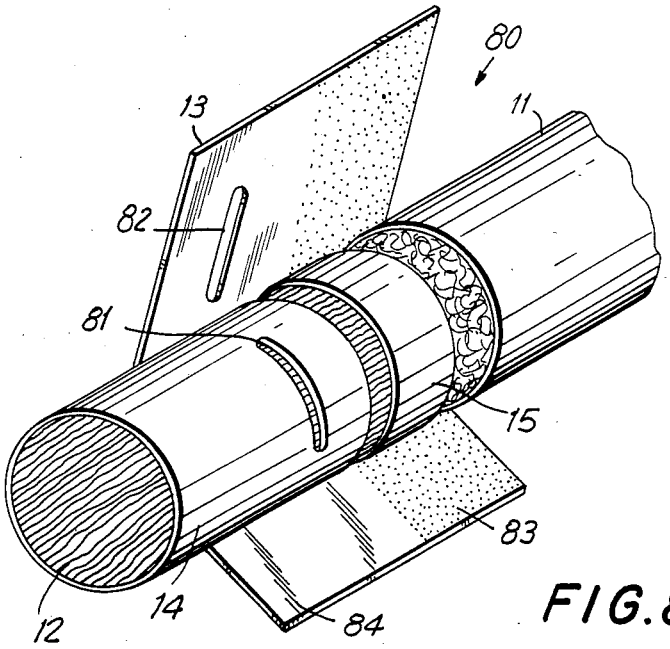
FIG. 8 is a fragmentary, partially exploded, perspective view taken from the mouth end of an alternative embodiment of the cigarette of FIG. 1, which is subject to longitudinal misalignment.

An alternative embodiment of the cigarette of FIGS. 1–3 is shown in FIG. 8. This cigarette 80 is also subject to longitudinal misalignment arising during use. Here, the openings 81 and 82 are formed in the mouth-end segment 14 of filter plug 12 and in the overlying tipping paper 13. There is only one band of tipping paper 13, having an adhesive portion 83 and a non-adhesive portion 84. Adhesive portion 83 overlies a portion of tobacco rod 11 and at least a portion of rod-end segment 15 of filter plug 12. The non-adhesive portion 84 extends from the mouth end of adhesive portion 83 to a point on mouth-end segment 14 between opening 81 and the mouth end of cigarette 80. The remainder of mouth-end segment 14 protrudes from tipping paper 12 for grasping and rotating by the smoker to vary the degree of dilution. If desired, this protruding portion of segment 14 can be covered by another band of tipping paper (not shown).

Figure 9:
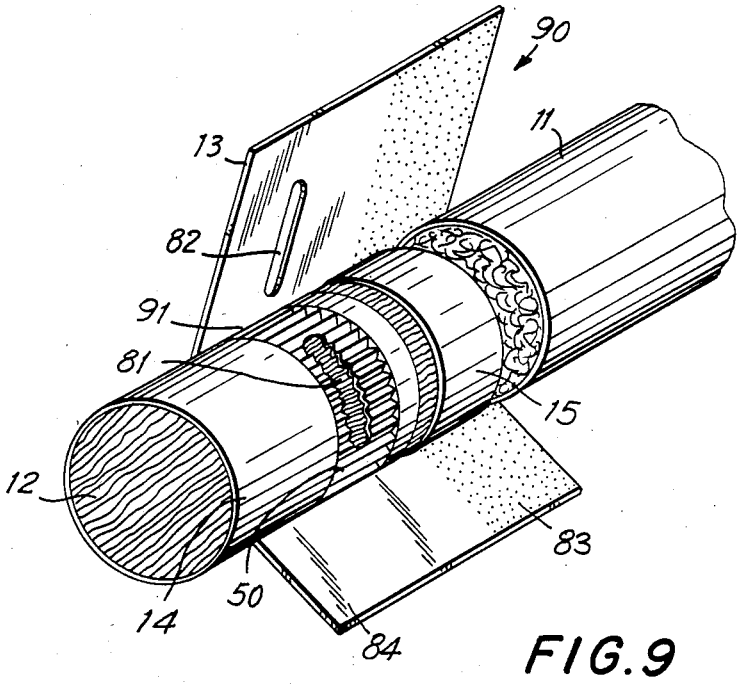
FIG. 9 is a fragmentary, partially exploded, perspective view of an alternative embodiment of the cigarette of FIG. 4 according to the present invention.

Cigarette 80 is subject to the same longitudinal misalignment as cigarette 10 for the same reasons. It is possible according to an alternative embodiment of the present invention to provide cigarette 90, shown in FIG. 9, with the same annular zone 91 of longitudinal depressions 50 as provided in cigarette 40 (FIGS. 4–7). Depressions 50 function in the same way in cigarette 90 as in cigarette 40 to render the variable dilution mechanism of cigarette 90 insensitive to minor longitudinal misalignment arising during use.

Although as shown in the carbodiments at FIGS. 4–7 and FIG. 9, the array of depressions 50 extends completely around the circumference of the cigarette in an annular zone, it is possible to provide a third embodiment of the cigarette according to the invention in which depressions 50 are provided only in those circumferential portions of the annular zone which contain and are immediately adjacent dilution openings 60–63 or 81, 82. However, in this third embodiment (not shown), it is necessary when forming openings 60–63 or 81, 82 that the filler plug be properly angularly aligned about its longitudinal axis so that the openings are formed within the array of depressions.

Thus, an improved variable dilution cigarette of the type described is provided which is not sensitive to longitudinal deregistration of the slits. One skilled in the art will realize that the present invention can be practiced by other than the embodiments described, which are presented for the purpose of illustration and not of limitation, and the present invention is limited only by the claims which follow.

What is claimed is:

1. A filter cigarette comprising a tobacco rod, a substantially cylindrical filter plug having a mouth end and a rod end open to the passage of air and smoke, plug wrapping circumscribing said filter plug, and tipping paper circumscribing and joining said filter plug and a portion of said tobacco rod, at least one of said plug wrapping and said tipping paper being substantially air-impermeable, said filter plug comprising a mouth-end segment axially connected to a rod-end segment for rotation about the axis of the cigarette, each of said segments having respective mouth and rod ends, said tipping paper having a first opening therein and said plug wrapping having a second opening therein underlying said first opening, said openings overlying one of said mouth-end and rod-end segments, such that rotation of said mouth-end segment relative to said rod-end segment varies the registry between the first and second openings for varying the air-dilution value of said filter cigarette; wherein:

said overlain segment comprises an array of angularly closely-spaced longitudinal depressions extending from a first point remote from said mouth end of said overlain segment to a second point remote from said rod end of said overlain segment, said openings being between said first and second points and within said array of depressions, such that said registry between said openings is insensitive to minor longitudinal misalignment of said openings.

2. The filter cigarette of claim 1 wherein said openings overlie said rod-end segment, the portion of said tipping paper containing said first opening rotating relative to said rod-end segment when said mouth-end segment is rotated.

3. The filter cigarette of claim 2 wherein said tipping paper extends from a third point on said tobacco rod to said mouth end of said filter plug, and has a first adhesive portion overlying said tobacco rod and at least a portion of said rod-end segment for attaching said filter plug to said tobacco rod, a second adhesive portion overlying at least a portion of said mouth-end segment, and an adhesive-free portion containing said first opening.

4. The filter cigarette of claim 3 wherein said tipping paper comprises first and second bands, said first band having said first adhesive portion and said second band having said second adhesive portion and said adhesive-free portion.

5. The filter cigarette of claim 4 wherein said second band is perforatedly connected to said first band.

6. The filter cigarette of claim 1 wherein said openings overlie said mouth-end segment, the portion of said tipping paper containing said first opening remaining stationary relative to said rod-end segment when said mouth-end segment is rotated.

7. The filter cigarette of claim 6 wherein said tipping paper extends from a third point on said tobacco rod to a fourth point between said openings and the mouth end of said mouth-end segment, and has an adhesive portion overlying said tobacco rod and at least a portion of said rod-end segment for attaching said filter plug to said tobacco rod, and an adhesive-free portion containing said first opening.

8. The filter cigarette of claim 7 wherein said tipping paper comprises first and second bands, said first band extending from said third point to said fourth point and said second band extending from said fourth point to the mouth end of said mouth-end segment and being adhered to said mouth-end segment.

9. The filter cigarette of claim 1 wherein the outer surface of the plug wrapping overlying the portions of said filter plug between said longitudinal depressions are flush with the outer surface of said plug wrapping.

10. The filter cigarette of claim 1 wherein said mouth-end segment and said rod-end segment are defined by a circumferential cut in said filter plug, said cut extending partially through said filter plug and defining a central axial core of filter tow material connecting said mouth-end segment to said rod-end segment.

11. The filter cigarette of claim 1 wherein said tipping paper and said plug wrapping are both substantially air-impermeable.

12. The filter cigarette of claim 1 wherein said tipping paper is air-permeable and said plug wrapping is substantially air-impermeable.

13. The filter cigarette of claim 1 wherein said tipping paper is substantially air-impermeable and said plug wrapping is air-permeable.

14. A method of manufacturing the filter cigarette of claim 1, said method comprising the steps of cutting a tobacco rod and a wrapped filter plug to a desired length, forming a circumferential cut in said wrapped filter plug and defining first and second segments and a central core along the longitudinal axis of said wrapped filter plug such that the first segment is rotatable relative to the second segment about the longitudinal axis of said wrapped filter plug, forming said longitudinal depressions in said wrapped filter plug, bringing said tobacco rod and said wrapped filter plug into axial alignment, overwrapping said tobacco rod and the wrapped filter plug with tipping paper, and forming said first and second openings in said tipping paper and plug wrapping.

* * * * *

UNITED STATES PATENT AND TRADEMARK OFFICE

CERTIFICATE OF CORRECTION

PATENT NO. : 4,646,763

DATED : March 3, 1987

INVENTOR(S) : Walter A. Nichols

It is certified that error appears in the above-identified patent and that said Letters Patent is hereby corrected as shown below:

Column 4, line 52, "do" (second occurrence) should be deleted.

Column 5, line 24, "carbodiments" should be -- embodiments --.

Signed and Sealed this

Eighth Day of March, 1988

*Attest:*

DONALD J. QUIGG

*Attesting Officer*

*Commissioner of Patents and Trademarks*